United States Patent [19]

Goedecke

[11] Patent Number: 4,875,258

[45] Date of Patent: Oct. 24, 1989

[54] GAS- AND LIQUID-TIGHT FASTENER

[76] Inventor: Hans J. Goedecke,
Gabriel-von-Seidl-Strasse 2a, D-8022
Gruenwald, Fed. Rep. of Germany

[21] Appl. No.: 141,624

[22] Filed: Jan. 7, 1988

[30] Foreign Application Priority Data

Jan. 8, 1987 [DE] Fed. Rep. of Germany ..... 3700427

[51] Int. Cl.[4] ..... A44B 19/32

[52] U.S. Cl. ..... 24/389; 24/384; 24/587

[58] Field of Search ..... 24/389, 384, 414, 382, 24/383, 390, 394, 391, 587

[56] References Cited

U.S. PATENT DOCUMENTS

| | | | |
|---|---|---|---|
| 2,229,216 | 1/1941 | Marinsky | 24/382 |
| 2,460,853 | 2/1949 | Siple | 24/587 |
| 2,637,086 | 5/1953 | Philips | 24/389 |
| 2,641,037 | 6/1953 | Gossner | 24/384 |
| 2,909,822 | 10/1959 | Botti et al. | 24/587 |
| 3,103,051 | 9/1963 | Iwatsuki | 24/389 |
| 3,509,927 | 5/1970 | Hasty et al. | 24/587 |
| 3,624,871 | 12/1971 | Osterkorn | 24/389 |
| 3,643,297 | 2/1972 | Urban | 24/414 |
| 3,668,745 | 6/1972 | Krupp | 24/389 |
| 3,948,705 | 4/1976 | Ausnit | 24/587 |
| 4,130,917 | 12/1978 | Shopalovich | 24/389 |
| 4,513,482 | 4/1985 | Fukuroi | 24/414 |
| 4,641,400 | 2/1987 | Moreland | 24/389 |
| 4,658,480 | 4/1987 | Morioka et al. | 24/384 |
| 4,731,911 | 3/1988 | Gould | 24/587 |

FOREIGN PATENT DOCUMENTS

| | | | |
|---|---|---|---|
| 0605599 | 2/1951 | United Kingdom | 24/389 |

*Primary Examiner*—Victor N. Sakran
*Attorney, Agent, or Firm*—Birch, Stewart, Kolasch & Birch

[57] ABSTRACT

The gas- and liquid-tight fastener includes a zipper an a sealing slide fastener. The zipper and the sealing slide fastener are arranged side-by-side in a plane which is perpendicular to the plane of the material wall to be sealed. The material wall is connected to the support tapes of the zipper, which have thickenings on their free ends, on which the teeth or spirals of the zipper are mounted. For actuating the zipper and the sealing slide fastener there is provided a slider made in one piece, which when being actuated closes the zipper, thereby also simultaneously forcibly closing the sealing slide fastener.

51 Claims, 9 Drawing Sheets

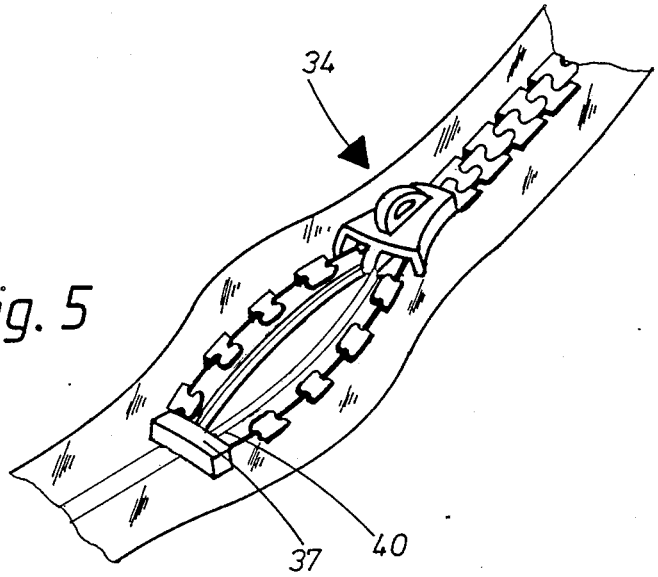
Fig. 5
Fig. 6
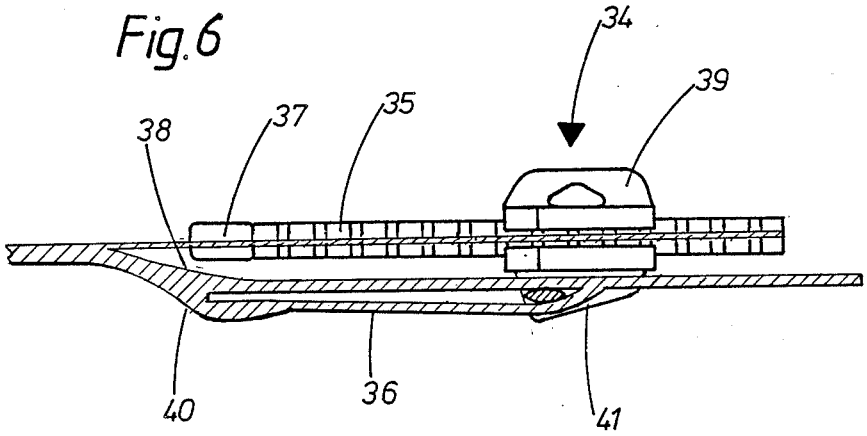

GAS- AND LIQUID-TIGHT FASTENER

BACKGROUND OF THE INVENTION

The present invention relates to a gas- and liquid-tight fastener for connecting two contiguous edge portions of a material wall to be sealed, that is the material wall of an object, particularly such as containers, clothing articles, tarpaulins and/or the like, in which the edge portions of the material comprise at least one fastener which receives the locking forces, particularly a zipper or a spiral fastening, and locking members coordinated to each other which may be brought into a sealing position to each other when the fastener is being closed.

Gas- and liquid-tight fasteners are needed in many fields, e.g. in gas- and water-tight protective suits for the fire brigade, for gas protection and for civil defense, in water-tight clothing articles for diving, sailing and surfing, in water-tight packing materials of delicate and sensitive apparatuses, in tent roofs and tarpaulins, in rucksacks, bags and the like.

There are already known in the art fasteners intended for the above applications. For connecting contiguous edge portions of a material wall to be closed there are used zippers whose teeth are encircled by the edge portions of said material wall, and the tissue of the material wall is secured to the teeth of the zipper by means of metal clips. The free ends of the material wall are slightly projecting and then forced to sealingly fit against each other when the zipper is closed, so that the junction of the two edge portions is achieved by means of the zipper, and the sealing is achieved by means of the free ends of the textile material of the wall to be closed.

However, the disadvantage of such zipper system is that it is of very restricted tightness. In manufacturing the known zipper system, which may be performed only with the aid of special machines, there must be met close manufacturing tolerances because a tight sealing cannot be achieved anymore when for instance a clip arrangement is slightly offset. Moreover, due to the use of special machines the known fastener is expensive. Finally, such fastener is not elastic but comparatively rigid so that it is hardly suitable for clothing articles. The slider of the known zipper is hard to be actuated because it tightly encircles not only the teeth of the zipper but also the plastic-coated textile material surrounding said teeth and the clips holding the textile material together, whereby considerable frictional forces occur between the slider and the projecting sealing lips of the coated textile material and the clips. The zipper is further sensitive to kinking and exhibits a low transverse tensile strength. In the most unfavorable case it may happen that the retaining clips loosen or are distorted so that the coordination of the teeth to each other is changed, something that will result in leakages. It may also happen that the free ends of the material to be closed, which serve as locking members, gape when the fastener is distorted or twisted, so that also in such case the required tightness is not guaranteed anymore. However, exactly on use of the fastener in textiles the fastener is exposed to permanent tensile, pressure and/or bending loads so that the known fastener system is little suitable for this purpose. Another drawback lies in that the known fastener has a very thick outer surface and also for this reason produces an aesthetically unfavorable impression of the clothing articles and is further uncomfortable for the person who wears such articles.

SUMMARY OF THE INVENTION

It is therefore the object of the present invention to improve a fastener of the above kind in a manner by which the aforementioned disadvantages are removed. This fastener shall be gas- and liquid-tight, comfortable when being worn in combination with textiles and not impair the outward appearance of a clothing article. Upon an increase of the internal pressure in a container which is sealed with a fastener of the generic kind, the sealing force should not decrease but rather tends to increase further. Due to a respective flexibility the fastener shall be comfortable in wearing and remain gas- and liquid-tight also when exposed to permanent pressure, tensile and/or bending loads. Finally it is intended that the manufacture of the fastener be easy and inexpensive and the fastener itself easily operable in that the occurence of high frictional forces or of a high operation resistance is avoided.

This object of the invention is achieved in an advantageous manner by the features recited in claim 42. Further preferred embodiments are shown in the subclaims.

In the fastener according to the invention the sealing is achieved by means of a sealing slide fastener, in which profile members are used as locking members, said profile members being engaged mechanically with the aid of a slider so that in this manner the profile members can be brought into a sealing position with each other. This sealing slide fastener is coordinated to a zipper whose slider may be actuated jointly with the slider of the sealing slide fastener owing to the fact that the sliders are connected to each other. When the zipper is closed or opened by actuating the slider, then also the sealing slide fastener is forcibly closed or opened at the same time, too, in that the sliders engage on the one hand the teeth coordinated to each other of the zipper at the opposing edge portions of the opening to be closed with the profile members pertinent to each other on the other hand. The tension is substantially transferred via the support tapes of the zippers into the laterally adjoining support foil of the material wall to be closed, while such transfer of tensions via the profile members is substantially avoided by arranging in an appropriate manner a distance piece between the profile members of the sealing slide fastener and the base body connected with the support foil.

The fastener according to the invention looks pleasant, is gas- and liquid-tight, easy to operate and elastic. Further, in the embodiment in which the teeth of the zipper and the profile members of the sealing slide fastener are arranged substantially in the same plane side-by-side, the fastener according to the invention is low in depth so that it is particularly suitable for clothing articles such as clothing for aquatic sports. Not requiring complicated special machines, it is easy to manufacture and therefore inexpensive. If necessary, the fastener according to the invention may be replaced without problem as it may be sewed up as a separate finished part with the web of fabric to be sealed. Finally, another advantage resides in that due to its flexibility the fastener may vault outward when a load is applied from inside, and the locking members which are formed by profile members may receive such a deflection owing to their elasticity, so that the sealing force can be maintained when an excessive internal pressure in a container occurs.

In the design of the fastener according to the invention the locking members of the zipper and of the sealing slide fastener can be arranged side-by-side in a plane which is perpendicular to the material wall which is to be sealed by said fastener, and the directions of movement of the teeth of the zipper extend orthogonally to those of the locking members of the sealing slide fastener when the zipper is opened and closed. In such a design the traction which can be received is the biggest, because the tractions can be received both by the support tapes of the zippers and by the base bodies of the sealing slide fastener and thus be led into the support foil of the material wall. However, in such a design the actuating forces of the slider on opening and closing are somewhat larger than in the design in which the locking members of the zipper and of the sealing slide fastener are arranged side-by-side in a plane perpendicular to the material wall, in a way that the directions of movement of the respective locking members for opening and closing the fastener extend in parallel planes. Therefore the fastener of the invention is more advantageously suitable in the one or the other design depending on the respective purpose. A further embodiment can be obtained with a fastener being low in depth - as this may be preferred e.g. for clothing articles or bags - the locking members of the zipper and of the sealing slide fastener are arranged side-by-side in the plane of the material wall to be sealed, in a way that the directions of movement of the respective locking members on opening and closing the fastener extend in orthogonal planes or in a common plane. Both embodiments of such design are relatively low in height and in the first case suitable for receiving large tractions and in the latter case for facilitating the actuation thereof.

The locking members made as profile members of the sealing slide fastener may have various forms. The locking engagement, however, which is brought about or released by the slider, is necessary in order to guarantee the desired tightness of the fastener under any tensile, pressure, bending and/or twisting loads.

The profile members of the sealing slide fastener may be made as one piece with the elastic base bodies. By selecting an appropriate material thickness or hardness and a bulge-shaped or loop-shaped profile design of the base bodies, the desired transverse elasticity of the base bodies can be obtained. When it is intended to use the fastener for closing an opening which is provided in a material wall, then both ends of the fastener are provided with end pieces, by which the locking members are held together and connected to the material wall. In the area of these end pieces the locking members of the sealing slide fastener have thickenings wedgeshaped in the direction of the locking slider openings, which thickenings enter into and sealingly lock the slide channels of the slider when the zipper is closed. For use in a clothing article the fastener according to the invention may be divided so that only one half of the zipper and of the sealing slide fastener is provided with an end piece while the respective other half may be introduced into said end piece and the respective slider. For this purpose the free ends of the introduceable halves of the fasteners are reinforced. If it is desired that the fastener is divisible proceeding from both of its ends, it is also possible to arrange two sliders movable independently from each other and arranged one behind another in a well-known manner both for the zipper and for the sealing slide fastener, and in such arrangement each slider of the zipper is attached to the respective slider of the sealing slide fastener.

The junction between the zipper and the sealing slide fastener may be obtained e.g. by high-frequency welding under the condition that the sealing slide fastener is made of PC and thus capable of being high-frequency welded. Also the zipper tape must be prepared for such high-frequency welding. For this purpose the tape contains PVC threads woven in the area of the welding zone, which threads homogenously bonds to the sealing slide fastener. Another possibility is the application of liquid PVC material onto the zipper tape which is impregnated and subsequently gelatinized at temperatures ranging from 150° C. to 180° C. and thus let in as a PVC layer in the tape tissue. If the sealing slide fastener is made of thermally mergeable plastic material such as polyethylene, the same could be thermally welded with the zipper tape provided that also in this case the tape comprises mergeable materials. If the zipper tape and the sealing slide fastener cannot be welded together, these components can be either agglutinated or sewed up with each other. If they are sewed up, there is a possibility of coating the seams with a sealing agent whereby the desired gas- and water-tightness can be obtained.

At the end of the gas- and liquid-tight fastener, i.e. where the ends of the locking members are fixed against each other, tightness problems may occur even when the fastener is closed. This is due to the fact that the wedge-shaped opening member of the slider, which member is arranged on the opening side of the slider and slips between the sealing faces of the sealing slide fastener when the fastener is opened and thus presses the locking members of the sealing slide fastener apart into their opened position, commonly prevents the sealing slide fastener from completely closing in its end portion even if the slider is completely and tightly closed. However, for certain applications, e.g. for containers to be sealed absolutely air- or water-tightly, a complete sealing of the fastener is required.

In a particularly preferred embodiment of the invention such complete sealing of the fastener is achieved in that the locking members of the sealing slide fastener comprise at either half of the fastener a guide extending outside the sealing area of the locking members in the longitudinal direction of the fastener, which guides are in engagement with a guide member at the slider in such manner that the locking members are moved apart from the outside when the sealing slide fastener is opened, that further the locking members are held together in their sealing position at that end of the sealing slide fastener which faces the opening side of the slider, and that finally in the area of the end position of the slider which faces the aforementioned end the guides of the locking members are designed in such a manner that the sealing slide fastener does not open in this final position.

Thus, the essential difference between this arrangement and the known zippers or slide fasteners is that the slide fastener according to the invention is not opened by a member which slides between the locking members of the slide fastener, i.e. that the two fastener halves of the slide fastener are thus not being pressed apart from inside by means of a wedge-shaped member, but that the fastener halves are rather pulled apart from outside so that there is no need for an opening member at the slider, which slides between the fastener halves. This provides then the possibility of effecting, by a special design of the locking-member-sided guides in the end area of the fastener, that the fastener does not open in this end area. Rather the opening mechanism of the sealing slide fastener remains effectless although the opening side of the slider was led completely to the end of the sealing slide fastener.

The opening movement of the locking members in the end area of the sealing slide fastener can most simply be prevented by omitting, in a preferred embodiment of the invention in the area of the final position of the slider, at least those locking-member-sided guides which cause the locking members to spread apart.

A preferred constructive solution, which enables the locking members to be moved apart from outside, is characterized in that the slider has a guide rail on either side, on which a guide of the locking member of the fastener half is guided so as to act from outside, and that the guide rails on the opening side of the slider open in a V-form. Hereby the opposing locking members of the two fastener halves are in the usual manner pressed together and brought into the closing position by the wedge-shaped tapering guide channel of the slider when the sealing slide fastener is closed. When the sealing slide fastener is being opened, the fastener halves which are first closed are pulled apart from outside by the V-like flaring guide rails of the slider.

Principally for realizing the variant according to the invention, most various forms of locking members may be employed, which comprise for instance one or more hook-shaped, mushroom-shaped or bulge-shaped portions which may be brought into sealing engagement with each other. In a preferred embodiment of the invention, however, it is provided that in the closed state of the sealing slide fastener one of the locking members embraces the other locking member from outside and that in such embracing position the locking members are in an engaging position with each other. A particularly reliable and durable sealing between the engaged locking members can be obtained in those cases when in a preferred embodiment of the invention the embracing locking member is provided with at least one spring extending in the longitudinal direction of the fastener, which spring biases said locking member into its closing position, in which it embraces the other locking member. The spring may be made particularly as a meander-shaped and helical spring wire which must leave in the longitudinal direction a through-gap for introducing the locking member to be embraced into the embracing locking member.

The guide rails of the slider are preferably made as flanges extending transversely to the opening direction of the locking members, which flanges are fastened to prependicularly hereto extending support portions of the slider in such a manner that it results in a substantially T-shaped configuration, in which one flange is embraced by one locking member and the other flange by the other locking member. Upon opening the sealing slide fastener, the external edges of the flanges act in a way that the two fastener halves are pulled apart, and upon closing the sealing slide fastener the internal edges of the flanges act in a way that the locking members are pressed against each other in a sealing position.

In the case of the above explained construction the opening effect of the slider in the end area of the sealing slide fastener can be made ineffective in that one edge portion of the guide of each fastener half, which edge portion embraces the area of the flange which lies outside in the opening direction, ends before the end of the sealing slide fastener. It can hereby be achieved that the guide flanges, which at the opening side of the slider flare outwardly in a V-shape, are without locking-member-sided counter-guide and therefore cannot act on the fastener halves in a way that the latter are being opened.

In detail, in a preferred embodiment of the invention the sealing slide fastener can be designed such that the two T-shaped configurations on both sides of the slider are arranged in such a manner that their cross-bars formed by the flanges are vertically offset and that the portions of the cross-bars which point to each other will partially overlap perpendicularly to the plane of motion of the sealing slide fastener, that further one of the locking members which is guided along the internal flange has a cavity which is adapted to the cross-section of the flange and which is open in the area of the support portion of the flange and that the other one of the locking members is approximately S-shaped in cross-section, embraces with one of its curved portions that part of the one locking member which is guided along the flange half which lies on the inside with respect to the support portion, and with the other curved portion embraces in a form-fitting manner the flange which lies on the outside. Suitable the locking engagement between the two locking members is achieved by engagement faces opposing each other in the area of transition of one curved portion to the other curved portion and extending substantially transversely to the direction of movement of the sealing slide fastener.

The fastener according to the invention enables the most various objects to be sealed gas- and/or liquid-tightly. Particularly the invention may be advantageously used for very large tents, air-supported balls or the like as such tents or halls consisting of separate webs which are simply combined with each other for assembling the tent or the hall. In such manner the size of such tents or halls can be most simply adapted to the respective requirements in that in case of need additional webs may be inserted thanks to the fastener according to the present invention.

BRIEF DESCRIPTION OF THE DRAWINGS

Further features, advantages and details of the invention will become apparent from the following description of preferred embodiments with reference to the drawings in which:

FIG. 5 shows a perspective view of a fastener according to the invention for closing an opening in a material wall;

FIG. 6 shows a side view on the respective halves of the zipper and of the sealing slide fastener in the opened condition;

DETAILED DESCRIPTION OF PREFERRED EMBODIMENTS

Figure 1:
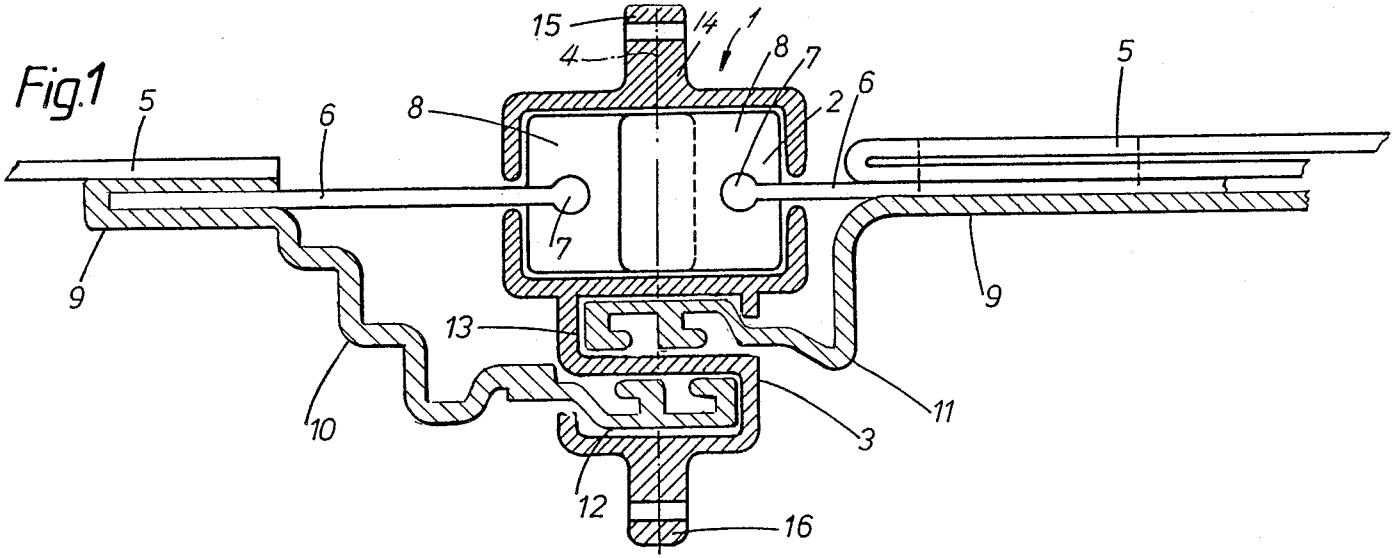
FIG. 1 shows a schematical cross-sectional view across the fastener according to the invention, in which the locking members of the zipper and of the sealing slide fastener are arranged side-by-side in a plane perpendicular to the plane of the material wall, and in which the directions of movement of the locking members on closing and opening extend orthogonally to each other.

The gas- and liquid-tight fastener 1 according to the invention as shown in the embodiment of FIG. 1 comprises a zipper 2 and a sealing slide fastener 3. The use of a spiral fastener with a helical nylon wire is also possible. This fastener has a flat bottom face so that the fastener according to the invention may generally be very flat. The zipper and the sealing slide fastener shown in FIG. 1 are arranged side-by-side in a plane 4 which is perpendicular to the plane of the material wall 5 which is to be sealed. The material wall 5 is connected to the support tapes 6 of the zipper, the free ends of the support tapes 6 have thickenings 7 on which the teeth or spirals (or helical locking members) 8 of the zipper 2 are mounted.

In FIG. 1, below the support tapes 6 there are respective portions of the sealing slide fastener 3 which are designated as base body 9 which is connected to profile members 12 and 13 respectively via respective distance pieces 10 and 11. The base body 9, the distance piece 11 and the profile member 13 for instance are made as one piece whilst the base body 9 with the distance piece 10 and the profile member 12 are of different materials, but nonetheless fixedly connected to each other. The profile members 12, 13 have hook-shaped portions integrally formed thereon which may engage each other. Other designs of the profile membes are conceivable, too, but provisions must be made for a forcibly locking engagement of the profile members when the zipper 2 is closed.

For actuating the zipper 2 and the sealing slide fastener 3 there is provided a slider 14 made as one piece which is in a known manner equipped with opposing grips 15, 16, which may comprise straps fastened thereto (not shown). The slider may in a well-known manner have a spring stop (not shown) which may be actuated via the strap and engages between the teeth or the spirals 8 in order to prevent the fastener from automatically releasing.

In the embodiment as shown both the support tapes 6 and the base body 9 with its distance pieces 10 and 11 may receive tractions in a plane which is substantially perpendicular to the plane 4. However, the distance piece 10 is designed bulge-shaped and the distance piece 11 loop-shaped so that the tractions may be received only when the distance pieces are stretched to their maximum.

Figure 2:
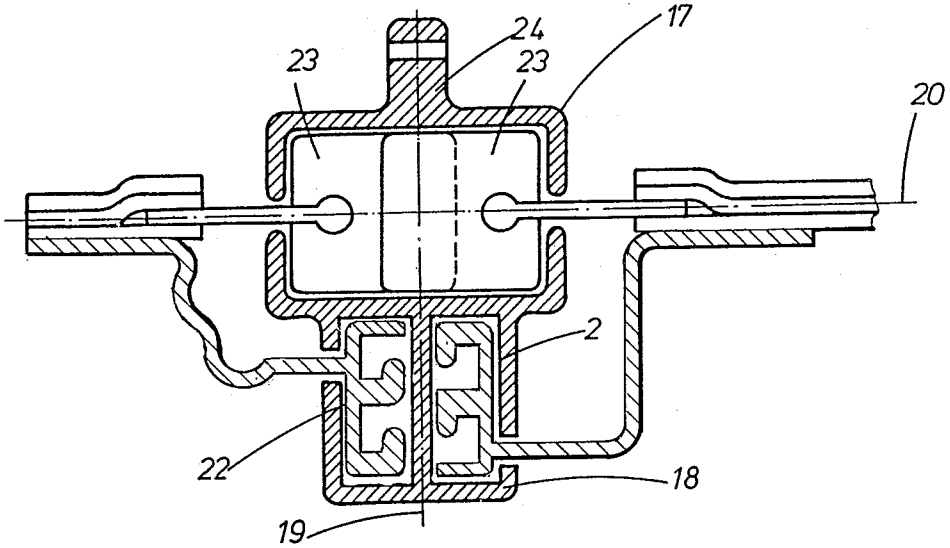

In the embodiment shown in FIG. 2 the zipper 17 and the sealing slide fastener 18 are arranged side-by-side in a plane 19 which is perpendicular to the plane 20 of the material wall. However, in contrast to the embodiment of FIG. 1 the profile members 21, 22 are turned by 90° so that the closing motions and opening motions of the teeth 23 and of the profile members 21 and 22 take place in planes which are parallel to the plane 20. On opening and closing the slider 24 may be actuated somewhat more easily as there occur lower frictional forces during the sliding.

Figure 3:
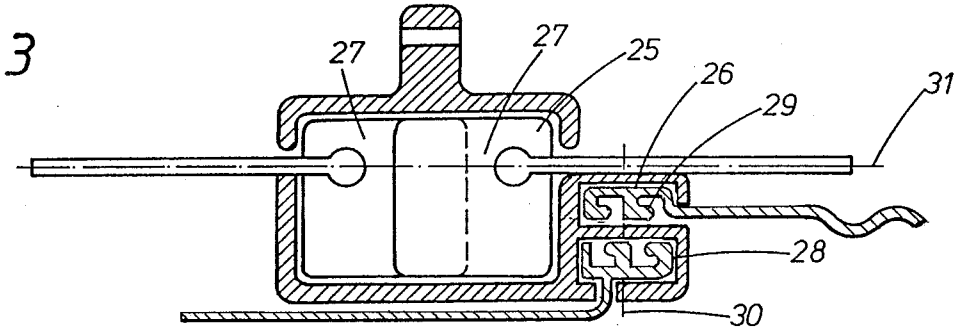
FIGS. 2 to 4 show further embodiments of the fastener according to the invention.
Figure 4:
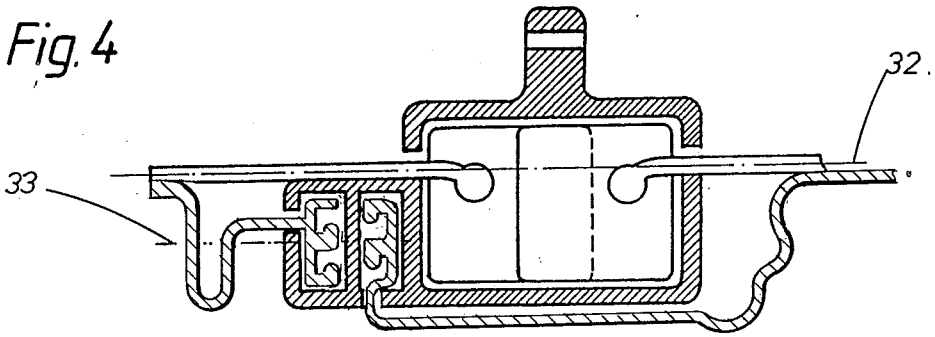

FIGS. 3 and 4 show further variants, in which the zipper 25 and the sealing slide fastener 26 are arranged side-by-side in a plane which is substantially defined by the material wall. In the embodiment according to FIG. 3 the directions of movement of the teeth 27 on the one hand and of the profile members 28, 29 on the other hand extend in orthogonal planes 30, 31 when the fastener is opened and closed, while in the embodiment according to FIG. 4 they extend in parallel planes 32, 33. Both variants of the fastener according to FIGS. 3 and 4 are designed to be low in depth.

The fastener 34 shown in FIGS. 5 and 6 shows that both the zipper 35 and the sealing slide fastener 36 have end pieces 37 and 38, respectively. The end piece 37 holds the locking members together which are formed by the teeth and serves limit motion of the slider 39. The end piece 38 has wedge-shpaed thickenings 40 which engage into and sealingly lock the slider channels 41 when the slider is in its final position.

Figure 8:
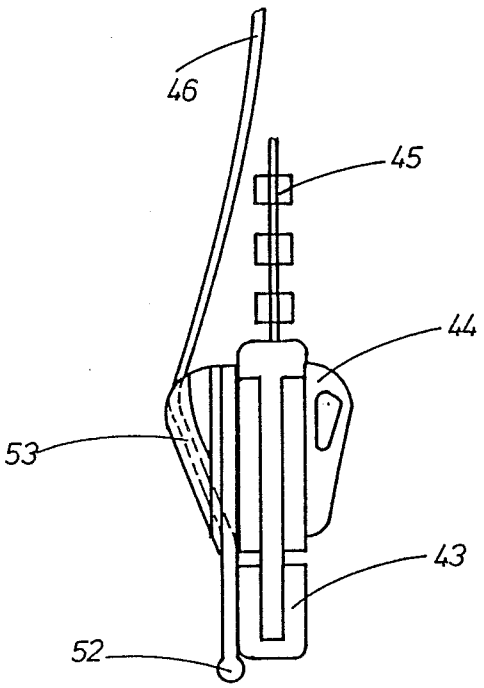
FIG. 8 is a side view of the fastener of FIG. 7.
Figure 7:
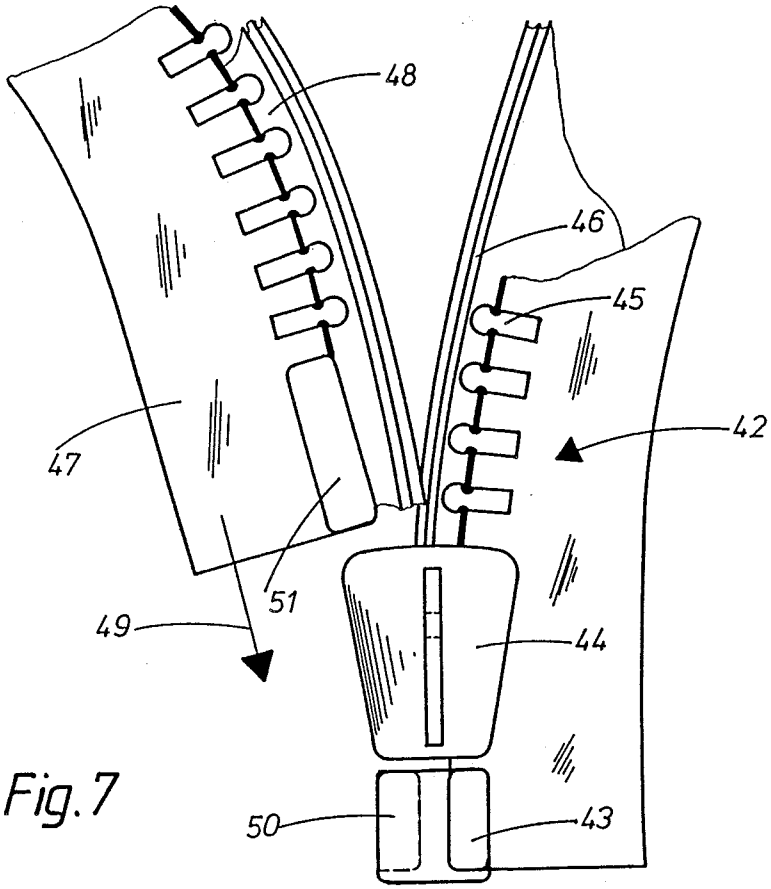
FIG. 7 is a plan view on the end of a divided fastener.

The fastener shown in FIGS. 5 and 6 is used in devices such as bags and is not divisible. In contrast thereto the fastener 42 shown in FIGS. 7 and 8 is intended to be used in clothing articles, and for this reason it is divisible. The end piece 43, which serves to limit the motion of the slider 44, is connected to the right half (with reference to FIG. 7) of the zipper support tape 45 and of the base body 46 of the sealing slide fastener, while the left half (with reference to FIG. 7) of the zipper support tape 47 and of the base body 48 of the sealing slide fastener may be inserted in the direction of the arrow 49 first into the left slider channel of the slider 44 and then into the left channel of the end piece 43. The zipper support tape 47 may be provided with a reinforced end piece 51. The channel 50 may have a lateral slot which may be open on its upper side as shown in of FIG. 7. The right end (with reference to FIG. 7) of the base body 46 of the sealing slide fastener has a safety thickening 52 in order to prevent it from being drawn out of the slide fastener channel 53 of the slider 44.

When the left zipper support tape 47 (with reference to FIG. 7) is introduced into the U-shaped end piece 43, also one end of the sealing slide fastener lying therebelow must be introduced into the pertaining channel of the zipper slider 44 so that the sealing members of the sealing slide fastener sealingly engage each other and that in this manner the starting position for actuating the gas- and liquid-tight fastener of the invention is achieved.

Figure 9:
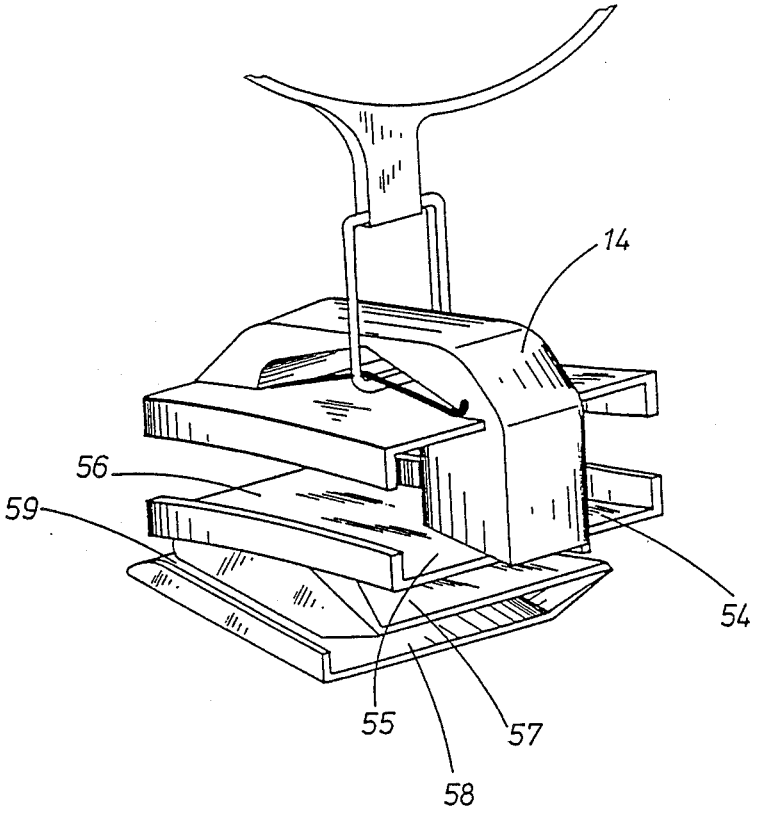
FIG. 9 is a perspective view of a slider.

FIG. 9 shows in an enlarged scale a perspective view of the slider 14 for the fastener according to the invention as shown in FIG. 1. In its upper portion the slider 14 has two entrance channels 54, 55 as well as an exit channel 56. The locking members of the zipper 2 are separately introduced into the entrance channels 54, 55 and they leave the slider through the channel 56 in the closed condition. Immediately under the upper section of the slider 14 there is the lower section of the slider with the two entrance channels 57, 58 as well as the exit channel 59. FIG. 9 shows that the slider is slightly conical from the entrance to the exit side, thus facilitating the insertion of the locking members of the zipper or spiral fastener and of the sealing slide fastener. The locking members leave the slider 14 through the channels 56, 59 in the closed condition, lying tightly upon each other.

Reference is now made to the embodiment according to FIGS. 10 to 15. Since this embodiment differs from the above described embodiments only by the different sealing slide fastener, the same reference numerals are otherwise used for corresponding parts.

The sealing slide fastener generally designated by the reference numeral 60 comprises two profile-shaped locking members 62, 64 which are fastened to the material wall 5 in the manner described above. In the closed condition of the sealing slide fastener 60 the locking members 62, 64 are sealingly adjoining each other in a form-fitting and force-locking manner. The opening and closing of the sealing slide fastener is performed by the slider 14, whose upper half is associated with the zipper and whose lower half is associated with the sealing slide fastener. When reference is now made to the slider 14, this is to mean generally the lower half of the slider which is associated with the sealing slide fastener.

The slider 14 comprises a plate 66, on the edges of which there are arranged carrier plates 68, 70 extending perpendicularly to the plate 66. On the ends of the carrier plates 68, 70 which oppose the plate 66, there are arranged guide plates 72, 74 extending parallel to the plate 66. The carrier plate 68 is higher than the carrier plate 70 so that the guide plates 72, 74 are superposed while the guide plate 74 is approximately in the middle between the plate 66 and the guide plate 72. The inward section **74*a* of the guide plate 74 projects approximately to the middle of the space which is defined by the plate 66, the carrier plate 68, the guide plate 72 and the carrier plate 70, while the section 72*a* of the guide plate 72 extends to near to the plane of the carrier plate 70. On the opening side of the slider 14, which, for instance in the representation of FIG. 14, lies on the top, the carrier plates 68, 70 including the external sections 72*b*, 74*b* of the guide plates 72, 74** open V-like, thus creating a flaring guide channel.

The locking member 64 is designed such that it embraces the guide plate 74 from all sides. An edge portion 76 of the locking member 64 overlaps the outwardly projecting plate section **74*b* of the guide plate 74. A bottom section 78 of the locking member 64 extends along the bottom side of the guide plate 74 and a further section 80 of the locking member 64 embraces the plate portion 74*a* and ends near the carrier plate 70. The bottom section 78 comprises a step extending in the longitudinal direction of the locking member 64, and the stop face 82** of the step is oriented perpendicular to the direction of movement of the sealing slide fastener and points outwardly.

The locking member 62 as a whole has approximately an S-shape. Its upper curved portion 84 embraces the correspondingly shaped sections 80 and 78 (the latter only partially), whilst the lower curved portion 86 is led along the guide plate 72, embracing the same. For this purpose the lower curved portion 86 with its internal face is led across the upper side of the plate section **72*a* and along the lower side of the guide plate 72 up to its enternal end. An edge portion 88 overlaps the plate section 72*b* of the guide plate 72**.

The lower curved portion 86 comprises a step which defines a stop face 90 facing the stop face 82. The two stop faces 82, 90 effect the mutual locking engagement of the two locking member 62, 64 in the closed condition of the sealing slide fastener.

Figure 10:
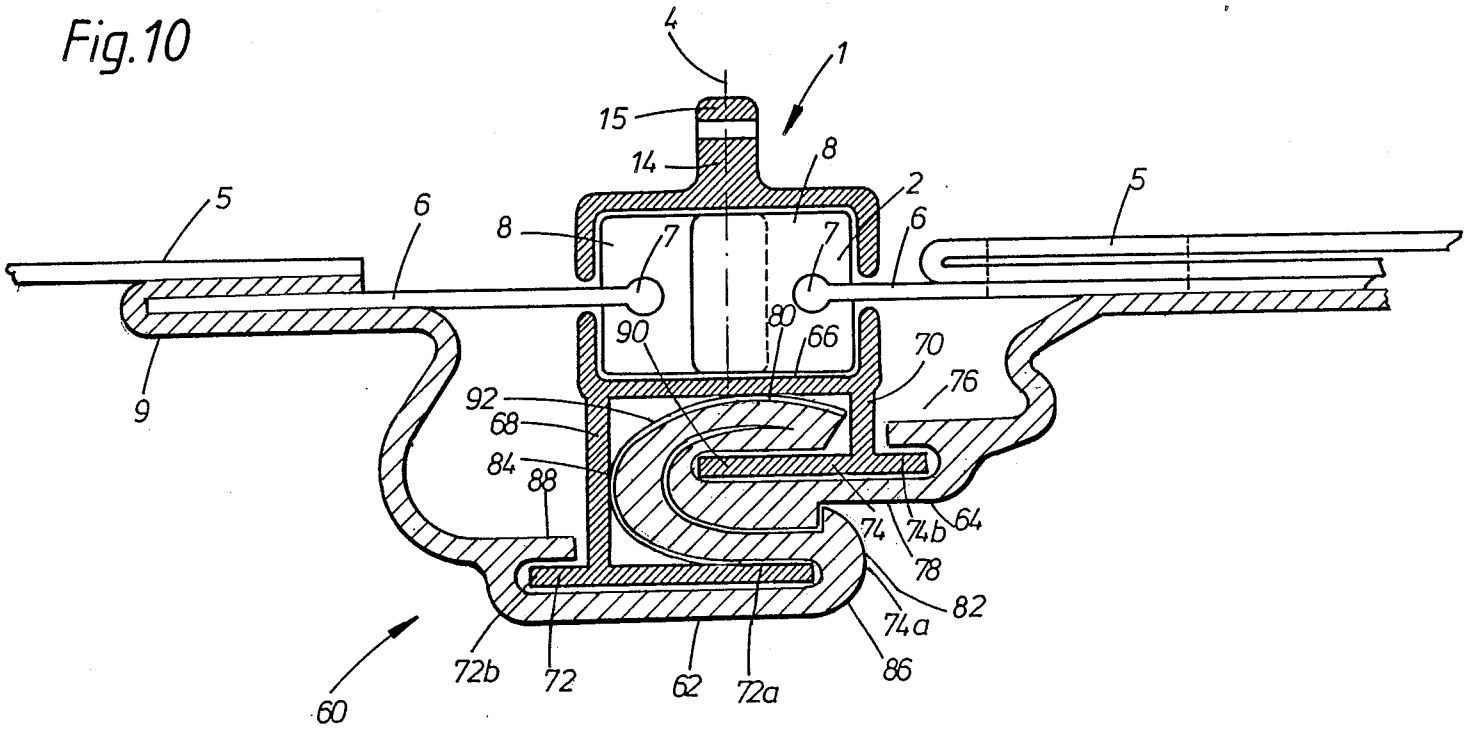
FIG. 10 is a schematical cross-sectional view similar to that of FIG. 1 according to an alternative embodiment of the sealing slide fastener.
Figure 11:
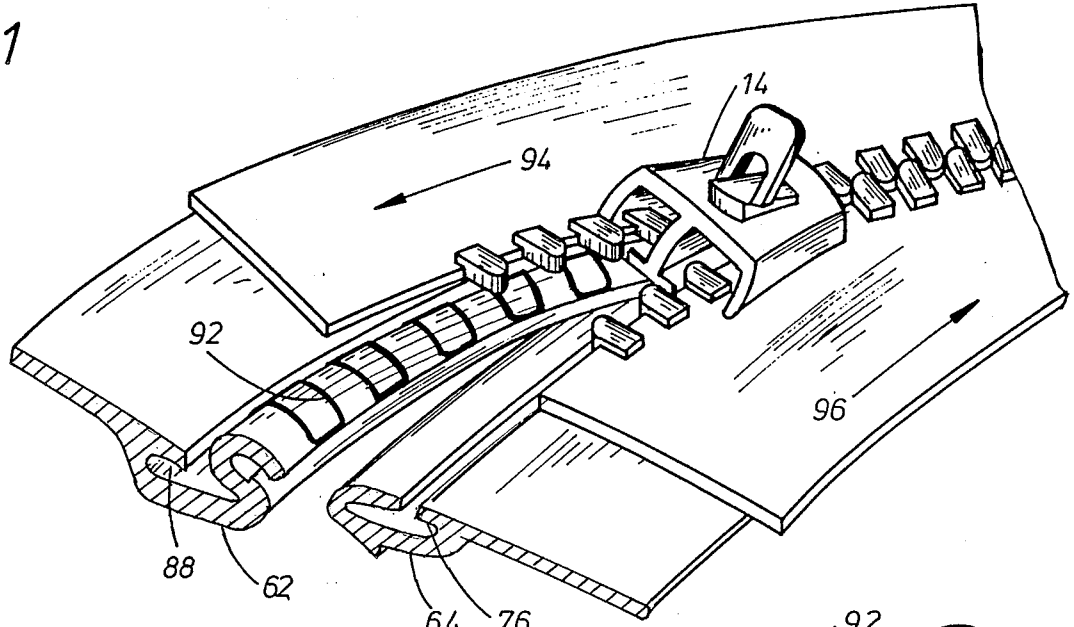
FIG. 11 is an oblique perspective view from above of the embodiment according to FIG. 10.
Figure 12:
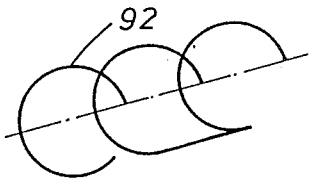
FIG. 12 is a perspective view of a spring which is used in the embodiment according to FIGS. 10 and 11.
Figure 13:
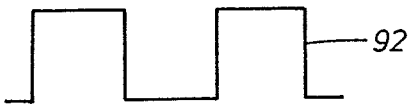
FIG. 13 shows the original form of the spring according to FIG. 12 prior to being curved.
Figure 14:
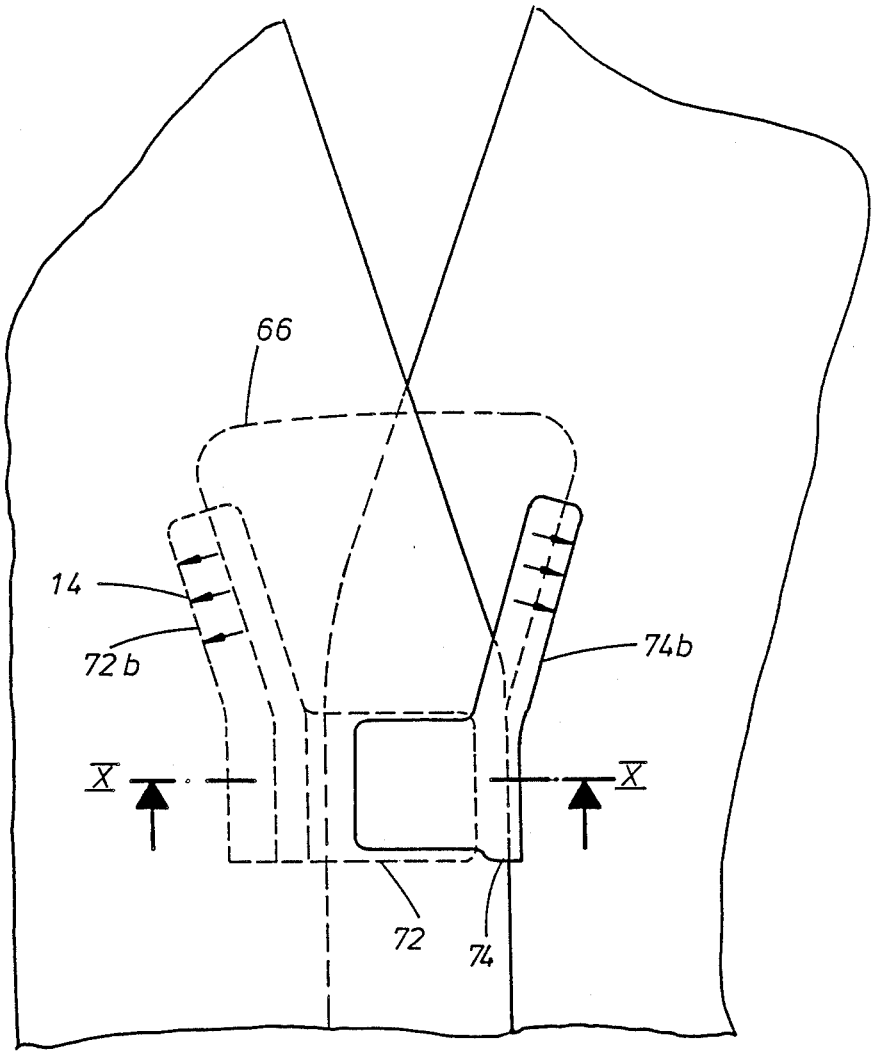
FIG. 14 is a view of the embodiment according to FIG. 10 from below.

In the closed condition of the sealing slide fastener the locking members 62, 64 take the configuration shown in FIG. 10. The curved portion 84 of the locking member 62 embraces then the sections 80, 78 of the locking member 64 while this sealing position is lockingly engaged. In order to reinforce the embracing force of the curved portion 84 and thereby to improve the cohesion of the locking members 62, 64 and the sealing thereof, the curved portion 84 is over its entire length surrounded by a wire spring 92 which may be seen particularly clearly in the FIGS. 11 to 13. The wire spring 92 is curved rectangularly or meander-like as indicated in FIG. 13. The wire spring formed in such a manner is then curved from the even configuration shown in FIG. 13 in the required manner and shifted onto the curved portion 84.

During the closing of the sealing slide fastener by pulling the slider 14 in the arrow direction 94, i.e. with the opening side of the slider 14 running in front, the locking members 62, 64, which are first separated from each other, are led towards each other by means of the guide plates 72, 74 and with the support of the carrier plates 68, 70, in such manner that the section 80, 78 of the locking member 64 is introduced into the opening of the curved portion 84 in which it finally lockingly engages by means of the stop and engagement faces 81, 90. When the sealing slide fastener is opened by shifting the slider 14 in the arrow direction 96 (FIG. 11), the locking members 62, 64, more exactly their engaged portions, are pulled apart due to the V-like expanding guide plate sections **72*b*, 74*b*** so that owing to the elasticity of the locking members the locking engagement is released.

Figure 15:
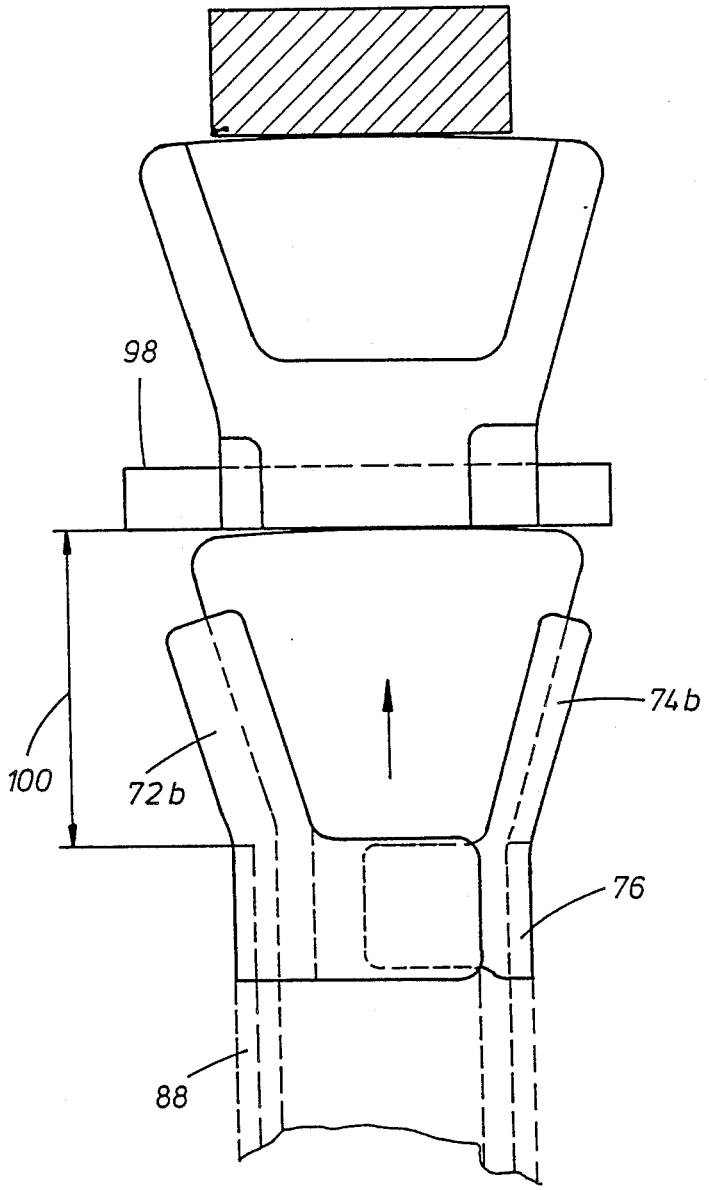
FIG. 15 shows another view from below according to FIG. 14, in which the slider is in its final position.

On the end of the sealing slide fastener, which faces the opening end of the slider 14, there is arranged an end piece 98 serving as a stop for the slider 14. In the area of the end piece the ends of the two halves of the sealing slide fastener are sealingly welded in an appropriate manner and they are in their sealing position relatively to each other. As seen in FIG. 15, the edge portions 76 and 88 of the locking members 62, 64 are removed in a final zone 100 of the sealing slide fastener. The length of the zone 100 is at least the same as the distance between the end piece 98 and the beginning of the V-shaped spreading of the guide channel and of the guide plate sections **72*b*, 74*b*. This results in that the spreading forces of the slider which normally act on the sealing slide fastener, cannot produce their effect in the zone 100 so that in the final position of the slider as shown in FIG. 15** the sealing slide fastener is sealingly closed through to its end.

Immediately following the V-shaped spreading area of the slider 14 the locking members 61, 64, being guided inside the guide channel of the slider 14, are forcibly retained in a sealing position in that they are encircled by the internal faces of the slider guide profile.

I claim:

1. A gas-tight and liquid-tight fastener for connecting two contiguous edge portions of a material wall of an object to be sealed, said material wall including first and second material layers fixedly connected to each other, the fastener comprising:

a zipper for joining the first layer of material;

a sealing slide fastener for joining the second layer of material;

said zipper and said sealing slide fastener being formed as a unitary slider member; and means for actuating said unitary slider member, wherein said means for actuating simultaneously opens said zipper and said sealing slide fastener when actuated in a first direction and simultaneously closes said zipper and said sealing slide fastener when actuated in a second direction, thereby simultaneously separating the two continguous edge portions of the sealing wall or joining them into tight locking engagement with each other, respectively.

2. The fastener according to claim 1, wherein said zipper and said sealing slide fastener are arranged superimposed in a plane perpendicular to the material wall of the object to be sealed, the directions of movement of said zipper and said sealing slide fastener being arranged in orthogonal planes when the fastener is being opened and closed, respectively.

3. The fastener according to claim 1, wherein said zipper and said sealing slide fastener are arranged in a plane perpendicular to the material wall of the object to be sealed, the directions of movement of said zipper and said sealing slide fastener being arranged in parallel planes when the fastener is being open and closed, respectively.

4. The fastener according to claim 1, wherein said zipper and said sealing slide fastener are arranged side-by-side in the plane of the material wall of the object to be sealed, the directions of movement of the respective zipper and sealing slide fastener being arranged in orthogonal planes when the fastener is being opened and closed, respectively.

5. The fastener according to claim 1, wherein said zipper and said sealing slide fastener are arranged side-by-side in the plane of the material wall of the object to be sealed, the directions of movement of the respective zipper and sealing slide fastener being arranged in a substantially common plane when the fastener is being opened and closed, respectively.

6. The fastener according to claim 1, wherein said unitary slider member forcibly engages the zipper and sealing slide fastener with each other when the unitary slide member is actuated.

7. The fastener according to claim 6, wherein said unitary slider member is made as one piece and includes four entrance channels and two exit channels which are immediately superposed or immediately adjoining each other.

8. The fastener according to claim 6, wherein said unitary slider member is connected from separate elements.

9. The fastener according to claims 6 or 8, wherein said unitary slider member is provided with an operating grip at two diverse locations thereon.

10. The fastener according to claim 1, further including profile members formed on said sealing slide fastener and connected on their free edges to an elastic base body.

11. The fastener according to claim 10, wherein the elastic base body is associated with a support tape via a loop-shaped bulging extension piece.

12. The fastener according to claim 11, further including a support foil comprising said support tape and teeth for said zipper, said teeth being arranged at the free ends of said support tape which are to be connected.

13. The fastener according to claim 10 or 12, wherein said elastic base body, said support tape, and said support foil are sewed up with each other.

14. The fastener according to claim 10 or 12, wherein said elastic base body, said support tape, and said support foil are agglutinated to each other.

15. The fastener according to claim 10 or 12, wherein said elastic base body, said support tape, and said support foil are welded to each other.

16. The fastener according to claim 10, wherein the profile members of said sealing slide fastener comprise one or more hook-shaped, bulging portions integrally formed thereon which may be caused to sealingly engage each other.

17. The fastener according to claim 10, wherein the profile members of said sealing slide fastener are made in one piece with said elastic base body.

18. The fastener according to claim 12, wherein said support tape is partially embedded in said elastic base body.

19. The fastener according to claim 10, wherein said profile members are made of a material harder than the adjoining elastic base bodies or exhibit a larger shore hardness than the adjoining elastic base bodies.

20. The fastener according to claim 1 or 10, wherein said sealing slide fastener is made of elastic plastic material.

21. The fastener according to claim 1 or 10, wherein said sealing slide fastener is made of rubber.

22. The fastener according to claim 1 or 10, wherein said sealing slide fastener is made of cautchoc.

23. The fastener according to claim 10, wherein the teeth of said zipper are held together at least at one of their two ends by one respective thickened end piece associated with the material wall.

24. The fastener according to claim 23, wherein the profile members of said sealing slide fastener include wedge-shaped thickenings in the area of an end piece, which thickenings engage with slider channels in order to tightly seal said slider channels when the fastener is being closed by said unitary slider member.

25. The fastener according to claim 10, wherein said zipper and said sealing slide fastener are divisible and wherein said teeth and said profile members are held together at their ends by an end piece and connected to the material wall, while the associated other profile members are introduceable through the unitary slider member into respective channels of the end piece.

26. The fastener according to claim 25, wherein the free ends of the profile members and zipper teeth introduced into the unitary slider member are reinforced.

27. The fastener according to claim 1 or 10, including two tandem-joined twin-sliders provided for the fastener, which twin-sliders enable the fastener to be opened and closed, proceeding from both fastener ends.

28. The fastener according to claim 1 or 10, wherein the fastener is sealingly connected by sewing to a web of material to be tightly sealed.

29. The fastener according to claim 1 or 10, wherein the fastener is sealingly connected by glueing to a web of material to be tightly sealed.

30. The fastener according to claim 1 or 10, wherein the fastener is sealingly connected by welding to a web of material to be tightly sealed.

31. The fastener according to claim 1 or 10, wherein the connection between the zipper and the sealing slide fastener is achieved by welding, particularly by high-frequency welding.

32. The fastener according to claim 10, wherein the profile members of the sealing slide fastener comprise at either fastener half a guide extending outside the sealing area of the profile members in the longitudinal direction of said sealing slide fastener, which guide is in engagement with one respective guide member arranged at the unitary slider member in such a manner that the profile members are moved apart from outside when the sealing fastener is being opened, that on the end of the sealing slide fastener, which faces the opening side of the unitary slider member, the profile members are held together in their sealing position, and that in the zone of the final position of the unitary slider member facing the aforementioned end the guides of the profile members are designed such that in this final position the sealing slide fastener does not open.

33. The fastener according to claim 32, wherein the area of the final position of the unitary slider member and at least the areas of the guides which cause the profile members to spread apart, are omitted.

34. The fastener according to claim 33, wherein the slider member has on both sides a unitary guide rail on which one respective guide of the profile member of the fastener half is arranged acting from outside, and that the guide rails open in a V-shape on the opening side of the unitary slider member.

35. The fastener according to claim 10, wherein in the closed condition of the sealing slide fastener one of the profile members embraces the other profile member from outside and that the profile members are lockingly engaged on each other in this embracing position.

36. The fastener according to claim 35, wherein the embracing external profile member is associated with at least one spring extending in the logitudinal direction of the fastener, which spring biases the profile member into its closing position, in which it embraces the other profile member.

37. The fastener according to claim 36, wherein the spring is made as a meander-shaped and helical spring wire.

38. The fastener according to claim 37, wherein the guide rails are made as flanges extending transversely to the opening direction of the profile members, said flanges being perpendicularly fastened to extending support portions of the unitary slider member in a manner which results in a substantially T-shaped configuration, in which one flange is embraced by one profile member and the other flange is embraced by the other profile member.

39. The fastener according to claim 38, wherein one edge portion of the guide of each fastener half, which edge portion embraces the area of the flange which lies outside in the opening direction of the profile members, ends before the end of the sealing slide fastener.

40. The fastener according to claim 38, wherein the two T-shaped configurations on both sides of the unitary slider member are arranged in a manner that their cross-bars formed by the flanges are vertically offset and that the portions of the cross-bars which point to each other partially overlap one another perpendicularly to the direction of movement of the profile members, that further one of the profile members which is guided along the internal flange has a cavity which is adapted to the cross-section of said flange and which is open in the area of the support portion of said flange and that the other one of the profile members is approximately S-shaped in cross-section, embraces with one of its curved portions that part of one profile member which is guided along the flange half which lies inside in respect of the support portion and with the other curved portion embraces in a form-fitting manner the flange which lies on the outside.

41. The fastener according to claim 40, wherein the locking engagement between the two profile members is achieved by engagement of faces opposing each other in the area of transition of one curved portion to another curved portion and extending substantially transversely to the direction of movement of the profile members.

42. The fastener according to claim 13, wherein the support tape is partially embedded in the elastic base body.

43. The fastener according to claim 14, wherein the support tape is partially embedded in the elastic base body.

44. The fastener according to claim 15, wherein the support tape is partially embedded in the elastic base body.

45. The fastener according to claim 1 or 10, wherein the fastener is sealingly connected by gluing to a web of material to be tightly sealed.

46. The fastener according to claim 1 or 10, wherein the fastener is sealingly connected by welding to a web of material to be tightly sealed.

47. The fastener according to claim 33, wherein the unitary slider member has on both sides a guide rail, on which one respective guide of the locking member of the fastener half is arranged acting from outside, and that the guide rails open in a V-shape on the opening side of the unitary slider member.

48. A gas-tight and liquid-tight fastener for connecting two contiguous edge portions of a material wall of an object to be sealed, said material wall including first and second layers of material fixedly connected to each other, said fastener comprising:

a zipper for joining the first layer of material;

a sealing slide fastener including profile members which profile members may be forcibly mechanically engaged into a tight locking engagement with each other or released from each other by an actuating device of said fastener connected to said zipper;

said zipper and said sealing slide fastener being formed as a unitary slider member;

said profile members of said sealing slide fastener including at either profile member a guide extending outside the sealing area of the profile members in the longitudinal direction of said sealing slide fastener, each of said guides being in engagement with a respective guide member arranged at said sealing slide fastener in such a manner that said profile members are separated from outside when the sealing slide fastener is being opened, that on the end of the sealing slide fastener which faces the opening side of the unitary slider member, the profile members are held together in their sealing position, and wherein in the zone of the final position of the unitary slider member facing the aforementioned end the guides of said profile members are designed such that in this final position the sealing slide fastener does not open;

a guide rail formed on both sides of said unitary slider member, wherein one respective guide of the profile member of the sealing slide fastener half is arranged acting from outside and said guide rails open in a V-shape on the opening side of said unitary slider member;

said guide rails being made as flanges extending transversely to the opening direction of said profile members, which flanges are fastened to perpendicularly extending support portions of the unitary slider member in a manner which results in a substantially T-shaped configuration, in which one flange is embraced by one profile member and the other flange is embraced by other profile member.

49. The fastener according to claim 48, wherein one edge portion of the guide of each sealing slide fastener half, which edge portions embrace the area of the flange which lies outside in the opening direction of the profile members, end before the end of the sealing slide fastener.

50. The fastener according to claim 48, wherein the two T-shaped configurations on both sides of the unitary slider member are arranged in such a manner that their cross-bars formed by the flanges are vertically offset and that the portions of the cross-bars which point to each other partially overlap one another perpendicularly to the direction of movement of the profile member, that further one of the profile members which is guided along the internal flange has a cavity which is adapted to the cross-section of said flange and which is open in the area of the support portion of said flange and that the other one of the profile members is approximately S-shaped in cross-section, embraces with one of its curved portions that part of one profile member which is guide along the flange half which lies inside in respect of the support portion and with the other curved portion embraces in a form-fitting manner the flange which lies on the outside.

51. The fastener according to claim 50, wherein the locking engagement between the two profile members is achieved by engagement of faces opposing each other in the area of transition of one curved protion to another curved portion and extending substantially transversely to the direction of movement of the profile members.

* * * * *